US007017740B2

(12) United States Patent
Itzkovitch

(10) Patent No.: US 7,017,740 B2
(45) Date of Patent: Mar. 28, 2006

(54) TOOL CONTAINER

(75) Inventor: Guy Itzkovitch, Cresskill, NJ (US)

(73) Assignee: Zag Industries Ltd., Rosh Ha'Ayin (IL)

( * ) Notice: Subject to any disclaimer, the term of this patent is extended or adjusted under 35 U.S.C. 154(b) by 66 days.

(21) Appl. No.: 10/076,591

(22) Filed: Feb. 19, 2002

(65) Prior Publication Data

US 2002/0125160 A1 Sep. 12, 2002

Related U.S. Application Data

(60) Provisional application No. 60/268,924, filed on Feb. 16, 2001.

(51) Int. Cl.
*B65D 85/28* (2006.01)

(52) U.S. Cl. ..... 206/372; 206/373; 220/254.6; 312/902

(58) Field of Classification Search ..... 206/349, 206/372–379; 220/212, 254.1–254.7, 315, 220/810; 312/902
See application file for complete search history.

(56) References Cited

U.S. PATENT DOCUMENTS 4,058,210 A * 11/1977 Mitchell ..... 206/372
5,244,265 A * 9/1993 Chiang ..... 312/902
5,339,956 A * 8/1994 Thomason ..... 206/372
5,386,907 A * 2/1995 Kahl et al. ..... 206/373
D378,874 S 4/1997 Dickinson et al.
D379,266 S 5/1997 Dickinson et al.
D385,110 S 10/1997 Yemini
5,680,932 A * 10/1997 Dickinson et al. ..... 206/372
D389,309 S 1/1998 Shaw
D394,955 S 6/1998 Dickinson et al.
5,762,411 A * 6/1998 Yemini ..... 312/902
5,826,718 A * 10/1998 Ahern et al. ..... 206/372
D402,111 S 12/1998 Dickinson et al.
D404,916 S 2/1999 Dickinson et al.
5,887,715 A 3/1999 Vasudeva
D416,682 S 11/1999 Tanji
D417,956 S 12/1999 Story et al.
D418,294 S 1/2000 Tanji
D424,297 S 5/2000 Story et al.
D434,225 S 11/2000 Story et al.
6,193,062 B1 * 2/2001 Rysgaard et al. ..... 312/902
6,637,592 B1 * 10/2003 Lai ..... 206/372

* cited by examiner

*Primary Examiner*—Luan K. Bui
(74) *Attorney, Agent, or Firm*—Pillsbury Winthrop Shaw Pittman LLP

(57) ABSTRACT

A tool container includes a case portion defining a storage space and a cover portion movably attached to the case portion moveable between a closed position in which the cover portion covers an opening into the storage space and an open position in which access to the storage space is permitted. The cover portion is securable in the closed position. The cover portion has an elongated level storage space for storing a level therein, and a secondary cover portion movably mounted to the cover portion for movement between a closed position wherein the secondary cover portion covers the elongated level storage space to retain the level therein and an open position wherein access to the level stored in the elongated storage space is permitted.

19 Claims, 12 Drawing Sheets

TOOL CONTAINER

The present application claims priority to U.S. Provisional Patent Appln. Ser. No. 60/268,924, Feb. 16, 2001 the entirety of which is hereby incorporated into the present application by reference.

FIELD OF THE INVENTION

The invention relates generally to tool containers.

BACKGROUND OF THE INVENTION

Small hand tools such as hammers, screwdrivers and the like are often stored and carried in a tool container. A tool container is a small box-like assembly that has a storage space that is covered by a cover portion. Tool containers are constructed to be small enough to be easily lifted and carried by one person using one hand. Typically the tools are stored in the storage space by placing them generally on top of one another in an unorganized pile. This arrangement of the tools is simple and convenient for most purposes, but may be undesirable when storing a relatively sensitive and easily damaged measuring instrument such as a level.

A typical level includes a precisely constructed (i.e., highly dimensionally accurate) elongated frame or body that includes a measuring surface and a plurality of bubble vials mounted in the body. The bubble vials are typically fluid filled tubes that are constructed of, for example, glass or plastic or other materials that can be damaged and are enclosed within protective transparent windows or covers that are also made of material that may be scratched or damaged. Storing a level as part of a pile of tools in a storage compartment of the tool container with other hand tools provides for a relatively sloppy storage arrangement, may damage the level, and may make access to the level difficult.

SUMMARY OF THE INVENTION

The present intention provides a tool container comprising a case portion defining a storage space and a cover portion movably attached to the case portion and being pivotally moveable between a closed position in which the cover portion covers an upwardly facing opening of the storage space and an open position in which access to the storage space through the upwardly facing opening is permitted. The cover portion is securable in its closed position. The cover portion has an elongated level storage space for storing a level therein. A secondary cover portion is movably mounted with respect to the cover portion for movement between a closed position wherein the secondary cover portion covers the elongated level storage space to retain the level therein and an open position wherein access to the level stored in the elongated storage space is permitted. A handle is connected to the cover portion to facilitate transport of the tool container.

The present invention also relates to a combination level and tool container.

Other aspects, features and advantages of the present invention will become apparent from the following detailed description, the accompanying drawings, and the appended claims.

BRIEF DESCRIPTION OF THE DRAWINGS

The present invention is further described in the detailed description which follows, by reference to the noted drawings by way of non-limiting illustrative embodiments, in which like reference numerals represent similar parts throughout the several views of the drawings, and wherein.

DETAILED DESCRIPTION OF THE INVENTION

While the present invention will hereinafter be described in connection with at least one example embodiment thereof, it should be understood that it is not intended to limit the invention to that embodiment. On the contrary, it is intended to cover all alternatives, modifications and equivalents as may be included within the spirit and scope of the invention as defined by the appended claims.

Figure 1:
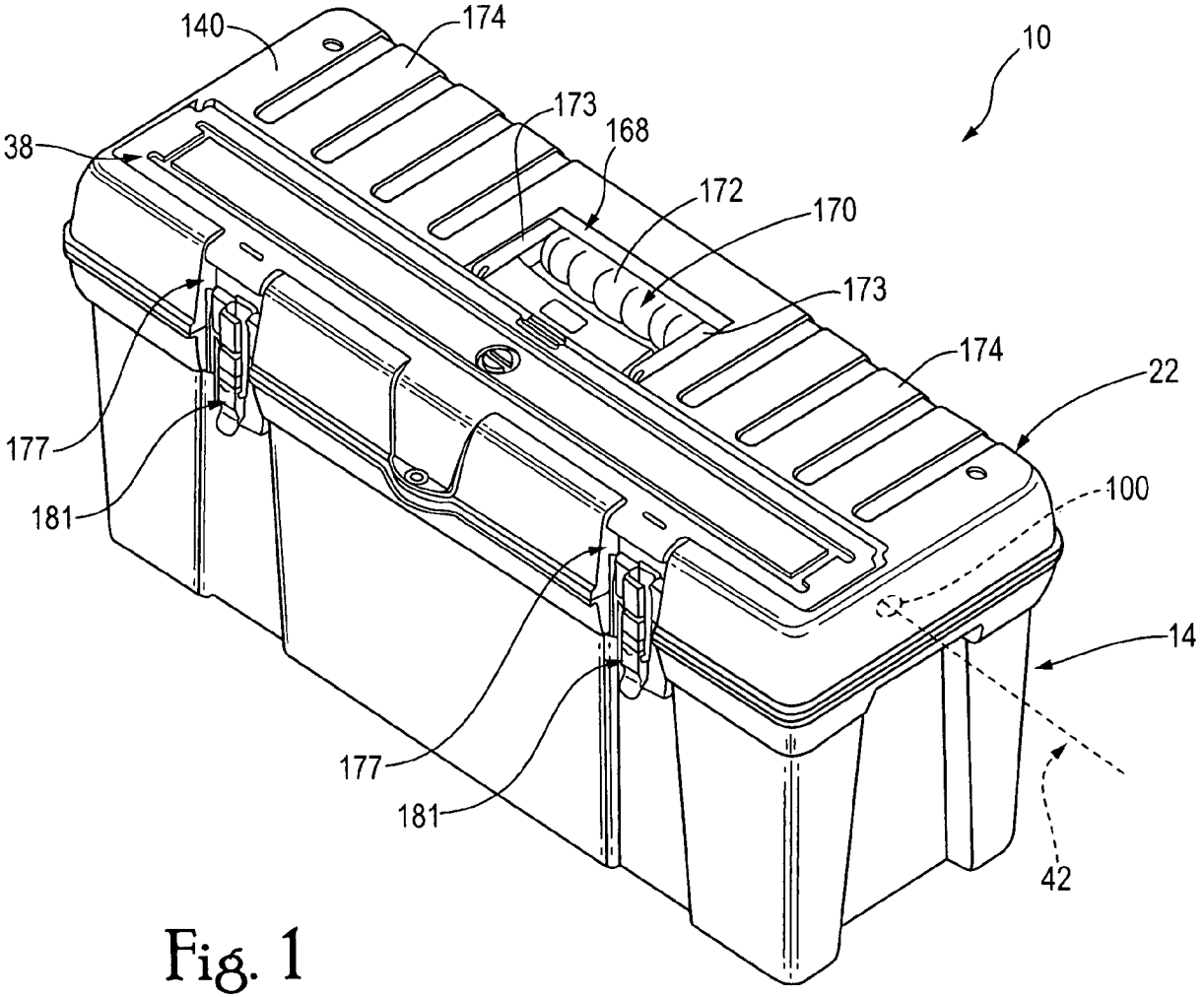
FIG. 1 is a perspective view of an embodiment of a tool container of the invention.

Referring now more particularly to the drawings, FIG. 1 illustrates a tool container according to an embodiment of the present invention. The tool container, generally indicated by reference numeral 10, may be used for storing and accessing items, such as work tools, e.g., hammers, drills, screw drivers, wrenches, etc., and work accessories, e.g., nails, drilling accessories, screws, nuts, bolts, etc. In the embodiment shown in FIG. 1, the tool container 10 generally includes a case 14, which defines a storage space, and a cover portion 22. The cover portion 22 may be pivotally attached to the case 14 by a hinge mechanism 26 along an upper edge of the case 14 at a first pivot axis 30. The cover portion 22 may be pivotally moveable about the first pivot axis 30 between a closed position in which the cover portion 22 covers an upwardly facing opening 34 into an upper region of the storage space and an open position in which access to the upper region through the upwardly facing opening 34 is permitted, the cover portion 22 being securable in the closed position. The case 14 includes a front wall 124, back wall 120, two side walls 132, and a bottom wall 133 to generally define storage space 18.

Figure 2:
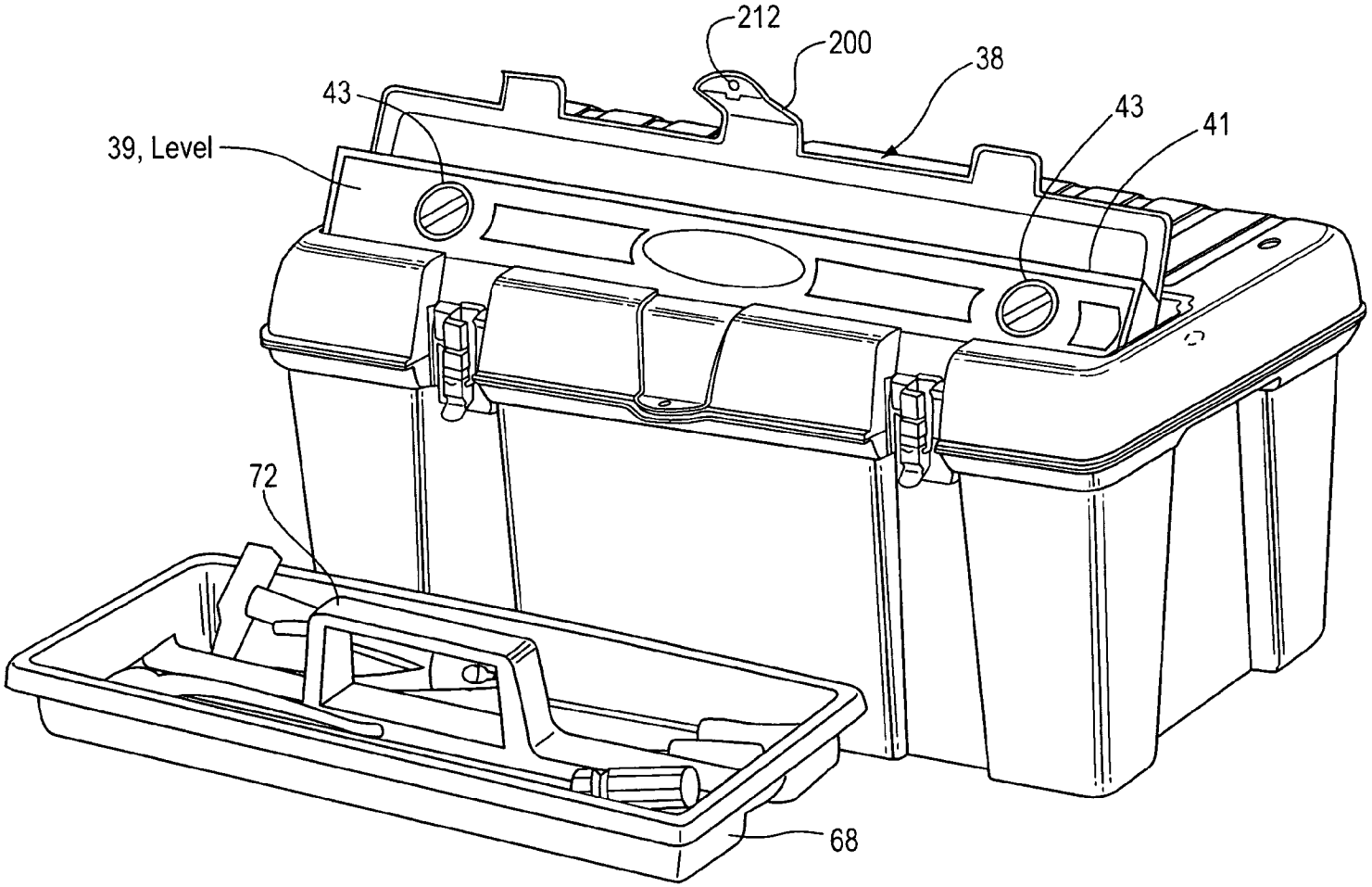
FIG. 2 is a perspective view of the tool container of FIG. 1 showing a second cover portion in the open position to expose a level and showing a tool box tray.

The cover portion 22 includes a second cover portion 38, that is pivotally mounted thereto about a second pivot axis 42. The second cover portion 38 may extend longitudinally of the cover portion 22. The second cover portion 38 covers a second storage compartment or area formed by a recess 64 in the cover portion 22, which is adapted to store a level 39 therein as can be understood from FIG. 2. The level 39 includes a measuring surface 41 and one or more bubble vials 43 for indicating whether or not a surface is level or plumb. An example of a level that may be used in combination with the tool container 10 is disclosed and described in U.S. Pat. No. 6,675,490, which patent is hereby incorporated by reference in its entirety into the present application. The second storage area 64 is preferably elongated to accommodate the elongated level 39, as can be understood from the figures. Levels are commercially available in several lengths, such as twenty four inches, for example. A tool container suitable for storing a twenty four inch level may be approximately 26 inches in length. The second cover portion 38 may also be configured to have the level 39 carried therein or removably attached thereto, as described below. The second cover portion 38 is pivotally moveable about the second pivot axis 42 between a closed condition with respect to the cover portion 22 wherein the top portion 46 of the second covet portion 38 is flush with the cover portion 22 (FIG. 1) and an open condition with respect to cover portion 22, wherein the level stored therein is accessible. The second pivot axis 42 is preferably substantially parallel to the first pivot axis 30.

Figure 8A:
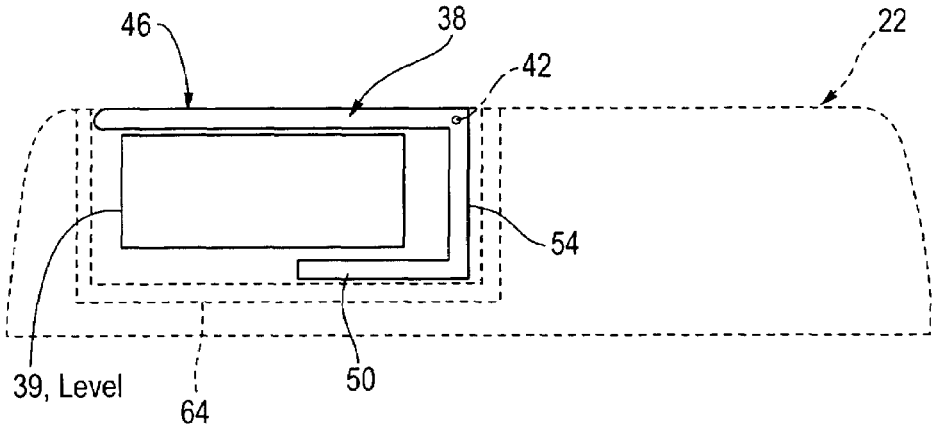
FIGS. 8A and 8B are cross-sectional views showing embodiments of the second cover portion that include examples of securing mechanisms for holding a level.
Figure 8B:
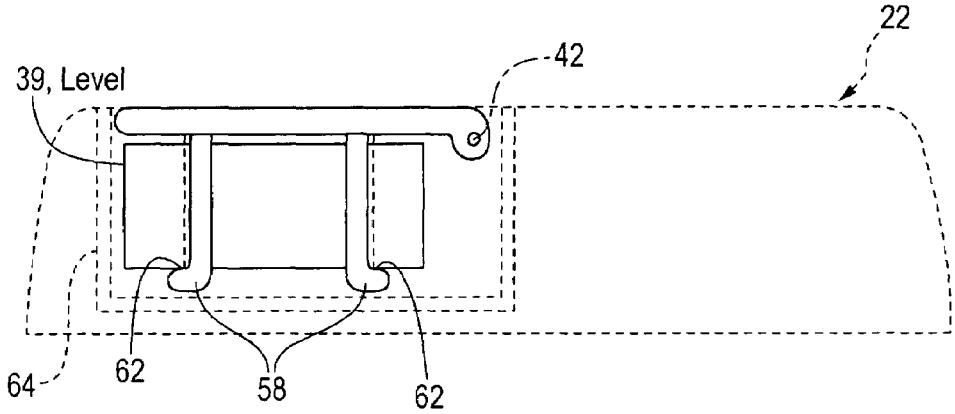

The second cover portion 38 may include, on an inner portion thereof, level mounting structure in the form of a securing mechanism to removably secure the level 39 to the underside of the top portion 46 of the second cover portion 38. For example, the securing mechanism may include a lip or lower wall portion 50 (see FIG. 8A) spaced apart from another wall portion defining the top portion 46 by a connecting wall portion 54, such that the second cover portion 38 has a U-channel cross-sectional shape which forms a partially enclosed space in which the level 39 can be placed. The cover portion 38 may be constructed so that the level 39 is held within the U-shaped channel by an interference fit. The level is shown mounted or "nested" within the U-channel for storage therein in FIG. 8A. Alternatively, the securing mechanism may include resiliently biased holding structures or clips 58 (see FIG. 8B) that may each extend through an opening 61 in the body portion of the level 39 to engage a locking edge or surface 62 on each holding structure 58 with a surface on the level 39, to thereby removably attach or secure the level 39 to the underside of the second cover portion 38. With the above securing mechanisms, the level is attached to the second cover portion 38. When the second cover portion 38 is closed (i.e., the top portion 46 is level with the cover portion 22), the level is stored within the storage compartment 64 formed in the cover portion 22.

Figure 9:
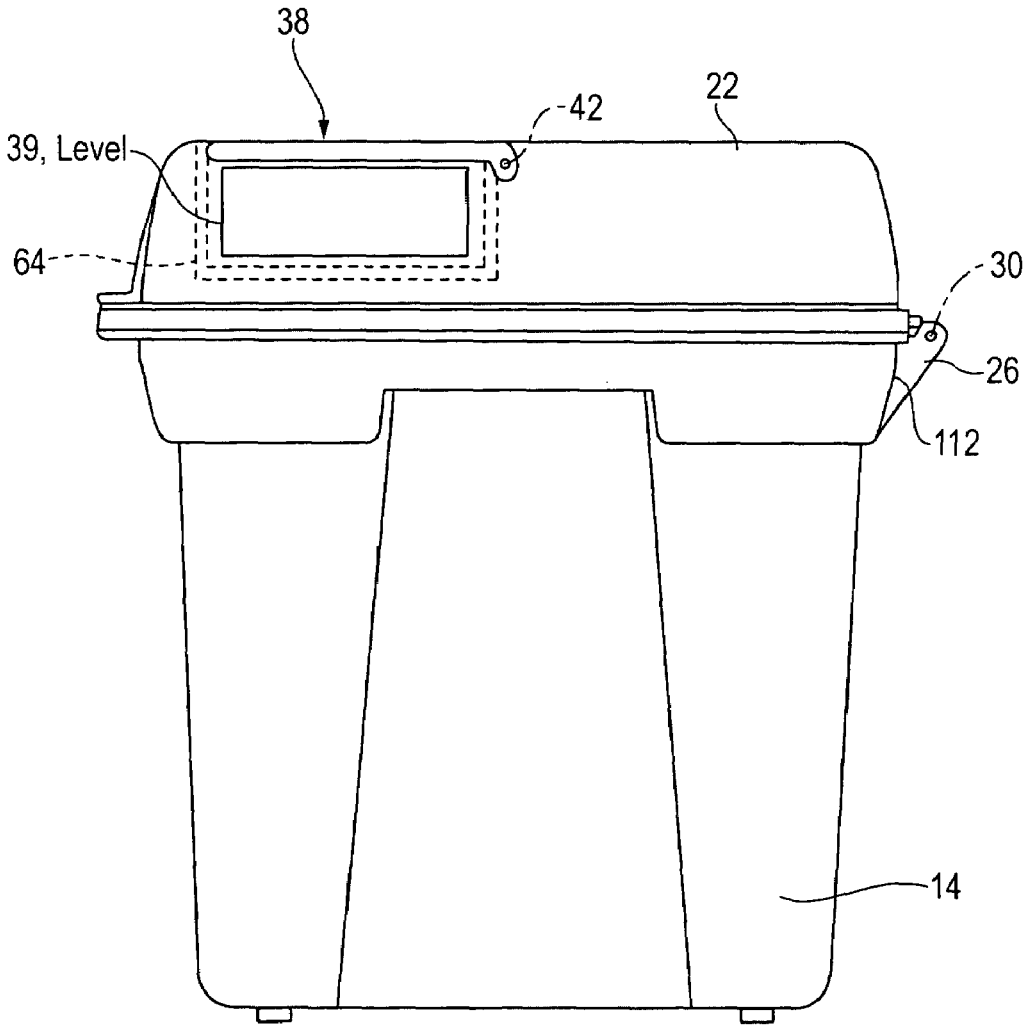
FIG. 9 is a cross-sectional view of the second cover portion without a securing mechanism.

Additionally, the level may simply be disposed within a recess or pocket-like storage compartment 64 formed within the cover portion 22, as shown in FIG. 9 without being mounted on or otherwise interengaged with the secondary cover portion 38. Here, the level 39 is simply placed in the recess 64 without being secured thereto or to the underside of the second cover portion 38. The recess 64 may be integrally formed with the cover portion. The recess 64 protects the level 39 from contact, and thus possible damage, with other tools that may be contained within the tool box 10. The recess 64 may also present where the level is attached to the second cover portion 38 via the securing mechanisms described above, to thus protect the level 39 front contact with other tools. In those embodiments in which the level 39 is not mounted on (i.e., not removably connected to or positioned within a compartment or storage space of) the second cover portion 38, a worker removes the level 39 by opening the second cover portion 38 and lifting the level 39 out of the recess 64. That is, when the second cover portion 38 is opened, the level remains in the recess 64. In those embodiments in which the level 39 is mounted on or carried by the second cover portion 38 (by being removably attached thereto or by being partially enclosed within a storage space formed therein, for example), the movement of the second cover portion 38 from its closed position to its open position lifts the level 39 out of the recess or storage compartment 64. This has several advantages including, for example, assisting the worker in removing the level from the compartment and positioning the level so that it can be grasped easily. This arrangement also makes it easier for the worker to place the level 39 back in its storage position in the storage compartment 64. The weight of the level also tends to move the second cover portion 38 in its closing direction to its closed position and the weight of the level helps keep the second cover portion 38 in its closed position. Removably attaching the level to the second cover portion 38 also affirmatively mounts the level to the second cover portion 38 in the recess which prevents the level item rattling or moving around in the recess when the tool container is being carried.

If the level is simply stored with the recess 64, the second cover portion 38 is essentially a pivotable cover that pivots about the second pivot axis 42, which, when in the open position, allows access to a storage space defined by recess 64.

The tool container 10 may also include a removable tray 68 configured to store items therein. The tray 68 includes an integrally formed handle 72. When contained within the reel container 10, the tray 68 is disposed within the case 14 and rests on ledges or protrusions 76 which form support surfaces that are integrally formed in the walls of the case 14. Alternatively, the tray 68 may engage ledges 80 that are integrally formed within the walls of the case 14, the ledges 80 being a top portion of recess channels 84 formed in the four walls of the case 14. When the tray 68 is stored inside the tool container 10, the tray 68 generally divides the storage space 18 into an upper region, which is defined by the space confined by the cover portion 22 and nay 68, and a lower region, which is defined by the space confined by the tray 68 and the four walls and bottom wall of the case 14.

Figure 10:
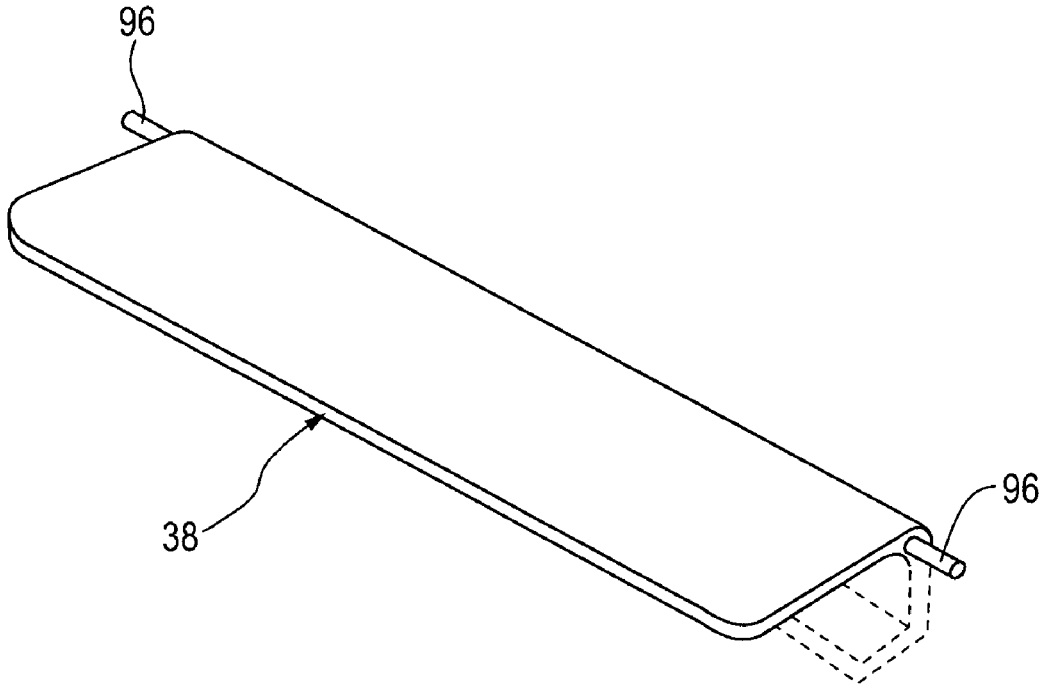
FIG. 10 is a perspective view of the second cover portion in isolation showing a hinge mechanism.

The second cover portion 38 includes a hinge mechanism which permits the second cover portion 38 to pivot with respect to the cover portion 22, about the second pivot axis 42. As shown in greater detail in FIG. 10. the hinge mechanism may include protruding portions 96 that engage corresponding female portions 100 (or holes) formed in the cover portion 22 (see FIG. 1). The protruding portions 96 may be integrally formed with the second cover portion 38, or they may be metal pins fixedly attached thereto.

Figure 3:
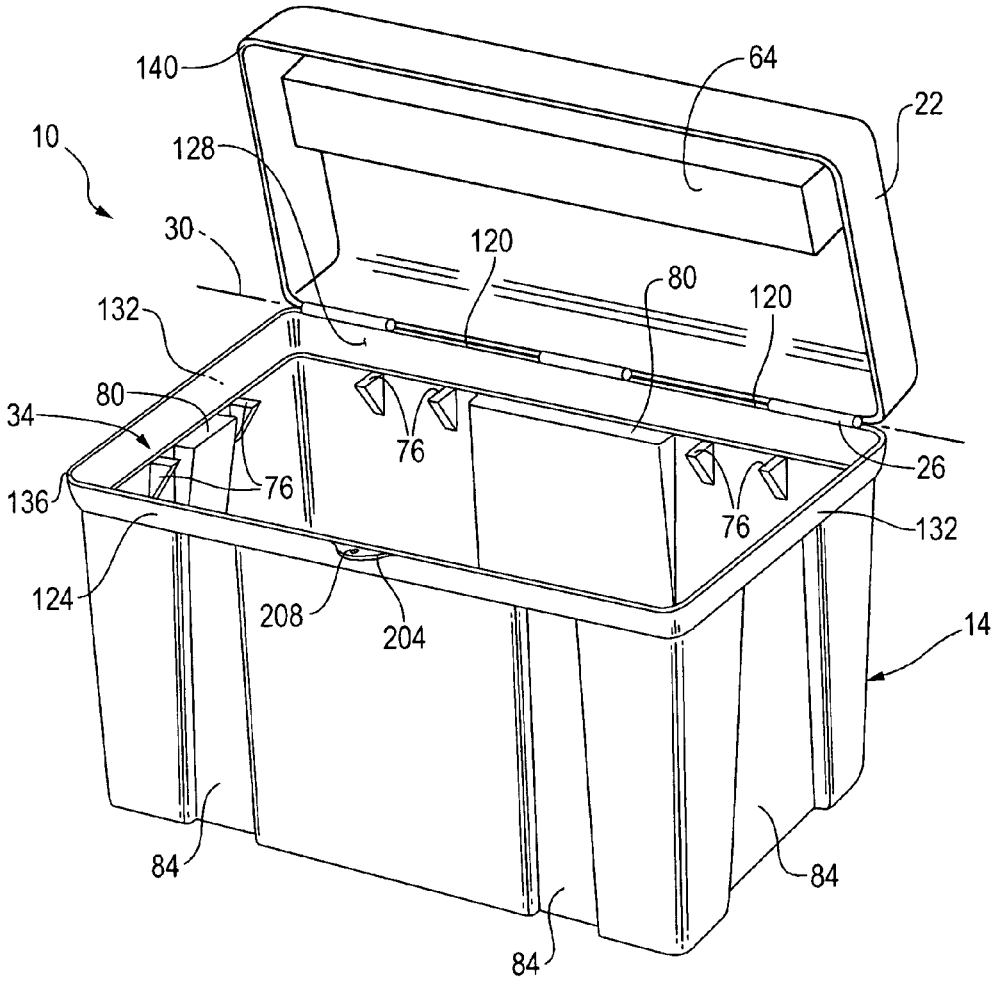
FIG. 3 is another perspective view of the tool container with a cover portion in the open position.
Figure 3A:
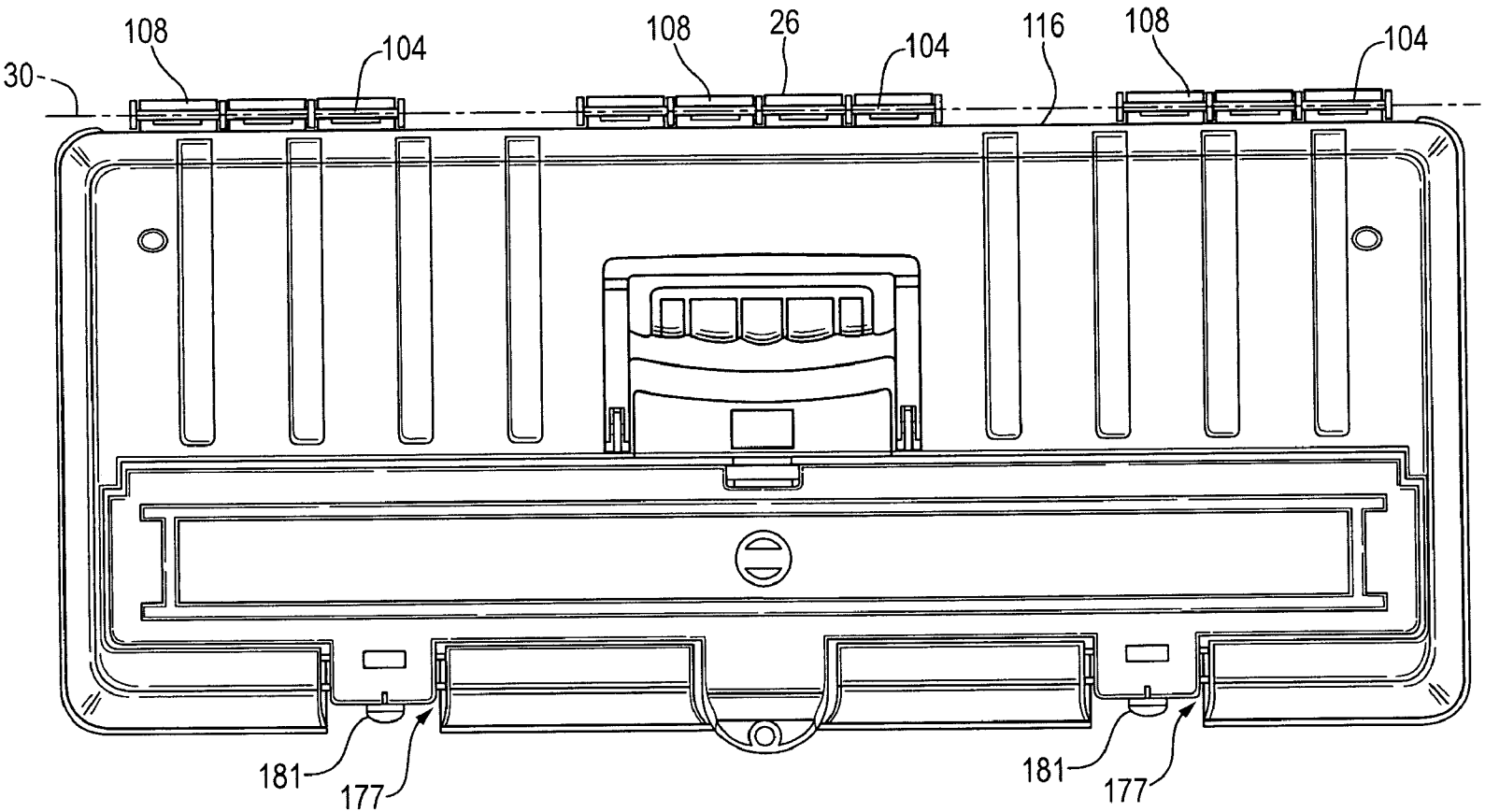
FIG. 3A is a top view of the tool container.
Figure 4:
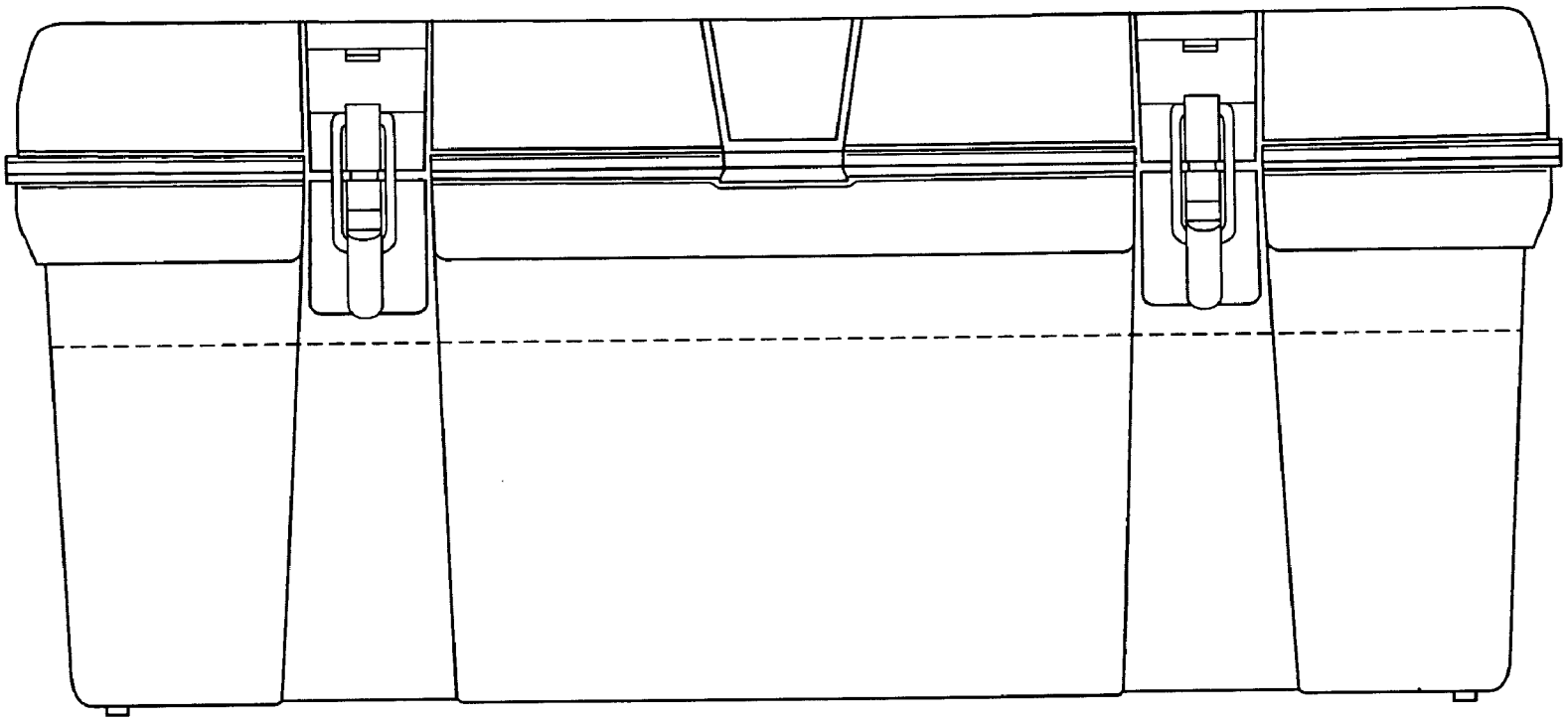
FIG. 4 is a front view of the tool container.
Figure 5:
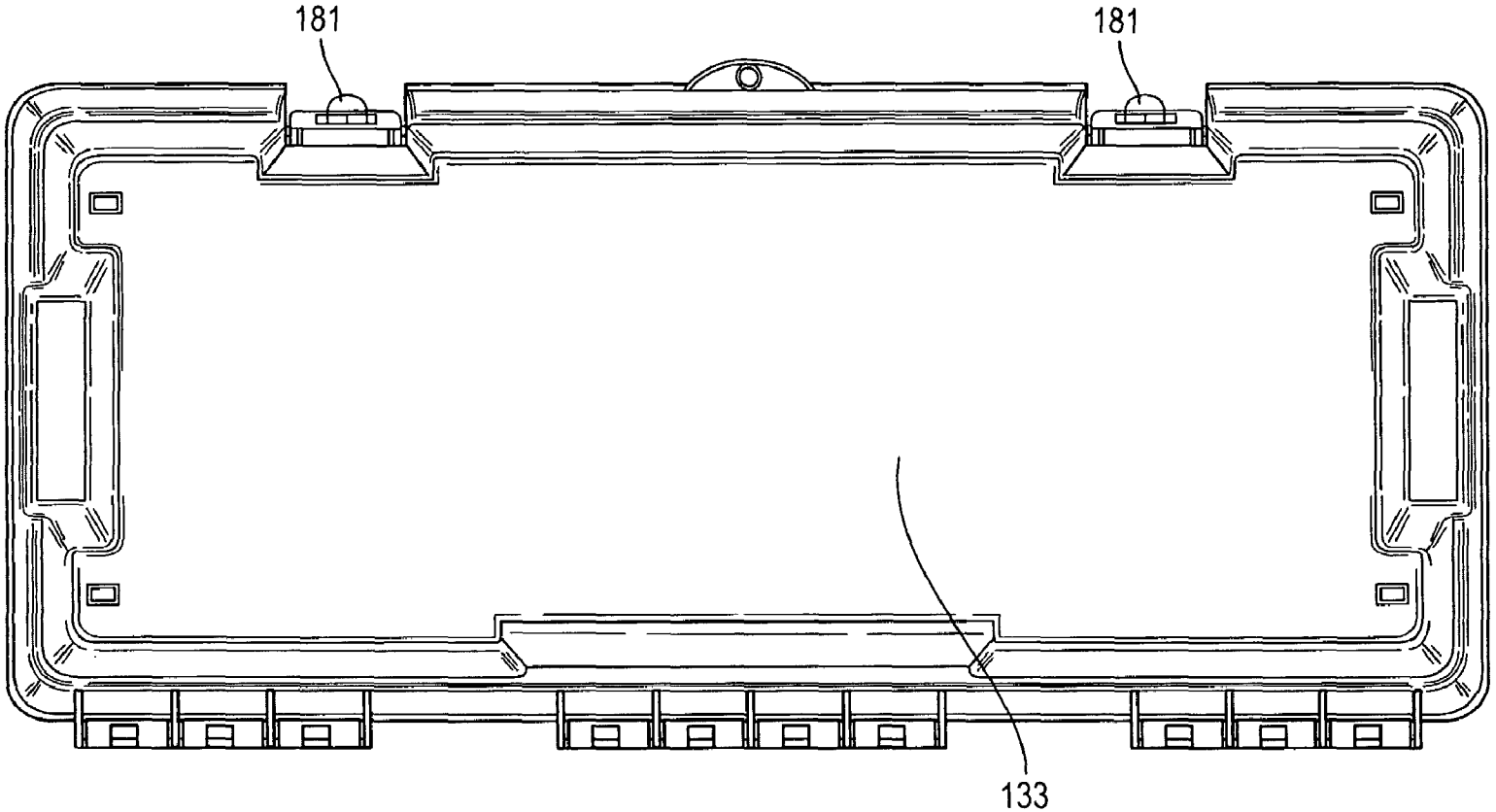
FIG. 5 is a bottom view of the tool container.
Figure 6:
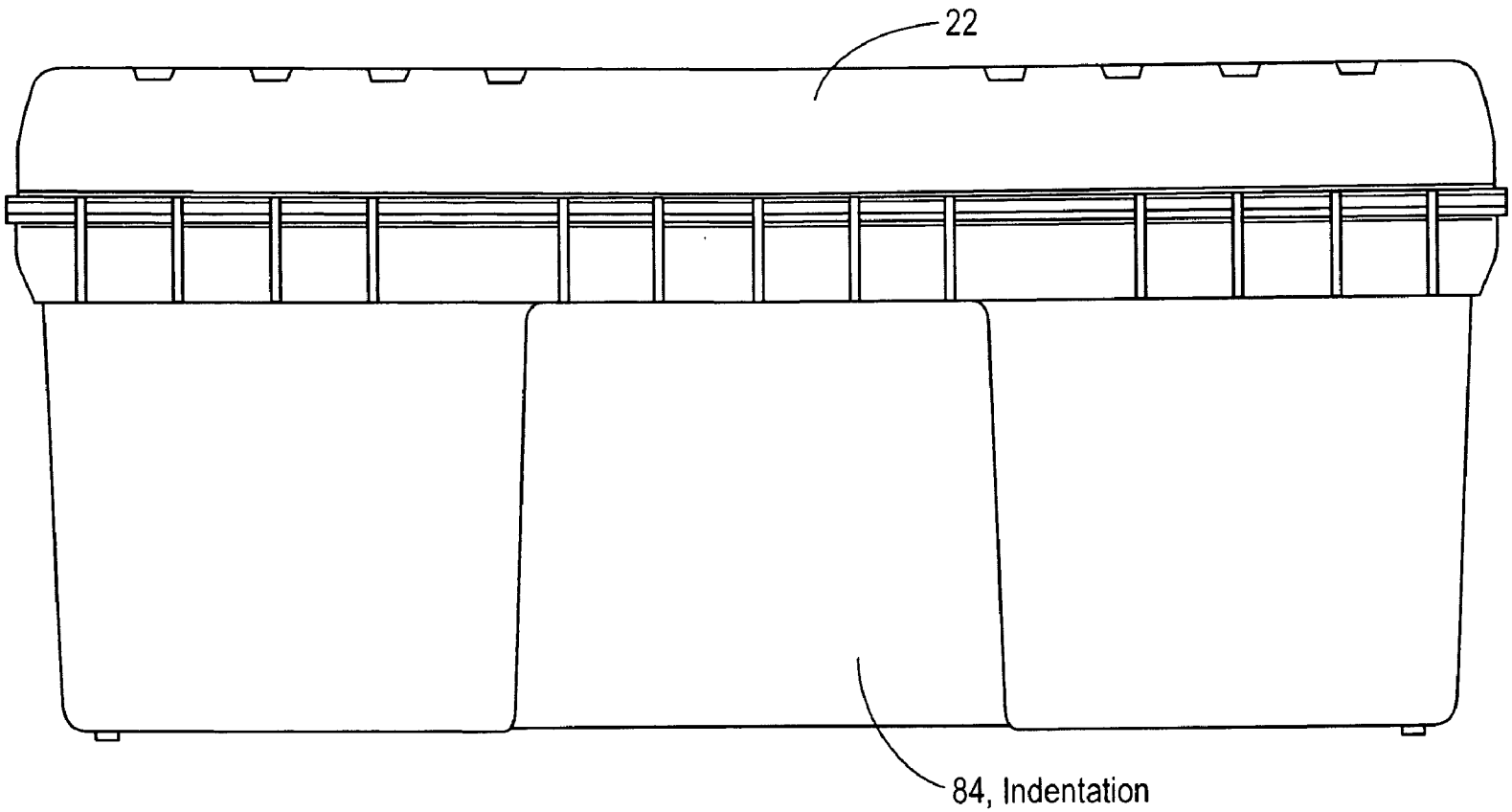
FIG. 6 is a back view of the tool container.
Figure 7A:
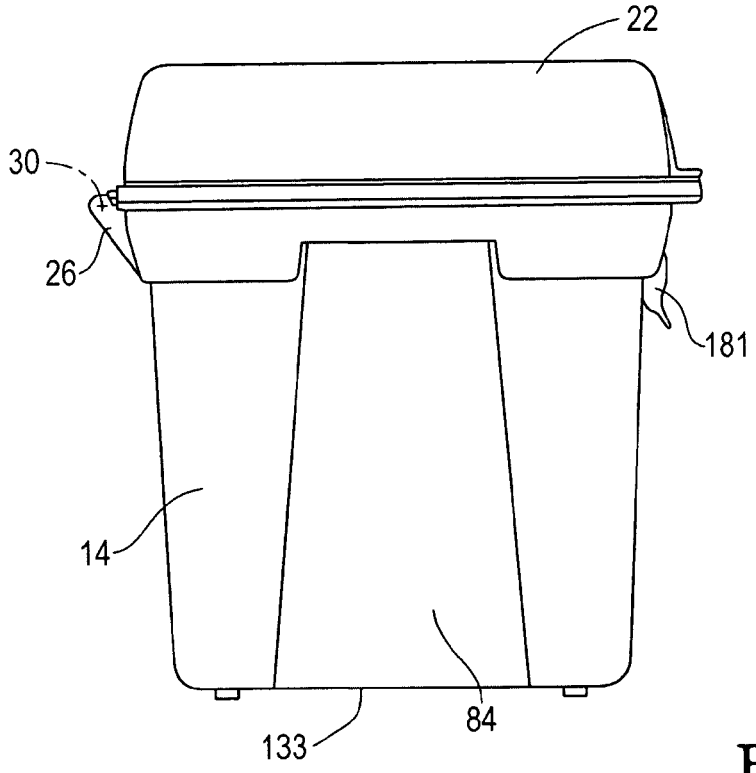
FIGS. 7A and 7B show views of opposite sides of the tool container.
Figure 7B:
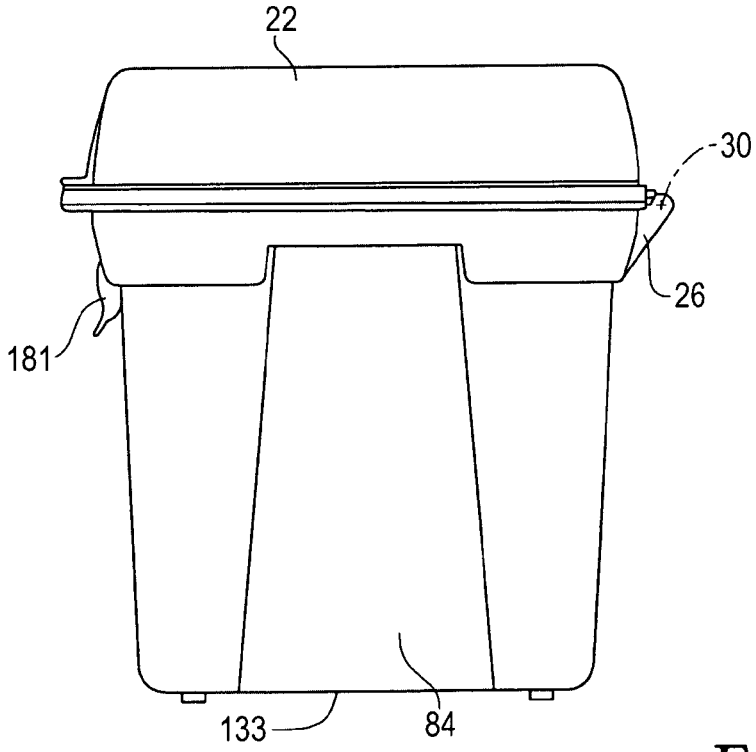

As noted above, the case 14 includes the hinge mechanism 26 connected to the cover portion 22 that permits the cover portion to pivot with respect thereto, about the first pivot axis 30. As shown in greater detail in FIG. 3A, the hinge structure 26 may include a plurality at cylindrical shaft members 104 supported in a series of aligned journaling members 108. The series of aligned journaling members 108 may extend from a rear surface 112 of the case 14 and from a bottom, rear edge 116 of the cover portion 22. Thus, the cylindrical shaft members 104 and the series of aligned journaling members 108 form the first pivot axis 30. The shaft member and the series of aligned journaling members 108 are positioned relative to the bottom, rear edge 120 of the cover portion 22 so as to allow the cover portion 22 to pivot about the pivot axis 30 without obstruction. The hinge structure 26 may include other types of hinge mechanisms, as generally known in the art.

The front, rear and side walls 124, 128, 132 of the case 14 define an upper peripheral surface 136, which is configured to mate with a bottom peripheral surface 140 of the cover portion 22 so as to support the cover portion 22 thereon when the cover portion 22 is in the closed position.

In general, the cover portion 22, case 14, and tray 68 may be made from plastic or any other suitable material such as metal, wood, or other material. Regardless of the material selected, each component 22, 14, 68 is preferably an integrally formed structure.

The cover portion 22 includes an upper exterior surface 166 that defines a handle receiving space 168 disposed centrally of the cover portion 22. Disposed within receiving space 168 is a handle 170 connected to the cover portion 22 which may be used to facilitate transport of the tool container. Also, the handle 170 may also include one or two handles (not shown) attached to the case 14. The handle 170 may be pivotally attached to the cover portion 22, or, alternatively, rigidly connected. The handle 170 may he substantially U-shaped with its open end facing toward the cover portion 22. The handle 170 may include a gripping portion 172 and a pair of leg portions 173 integrally extending therefrom and pivotally attached to the cover portion 22.

The exterior surface 166 may include a number of projections 174 that extend upwardly from the cover portion 22. The projections 174 may be arranged in any configuration to enhance aesthetic appeal or to provide a work surface for the tool container 10.

The cover portion 22 may be secured in a closed position with at least one releasable locking mechanism, generally indicated by reference numeral 181. In the illustrated embodiment, two locking mechanisms 181 are mounted within recessed portions 177 that are laterally spaced apart on a peripheral portion of the cover portion 22.

Figure 1A:
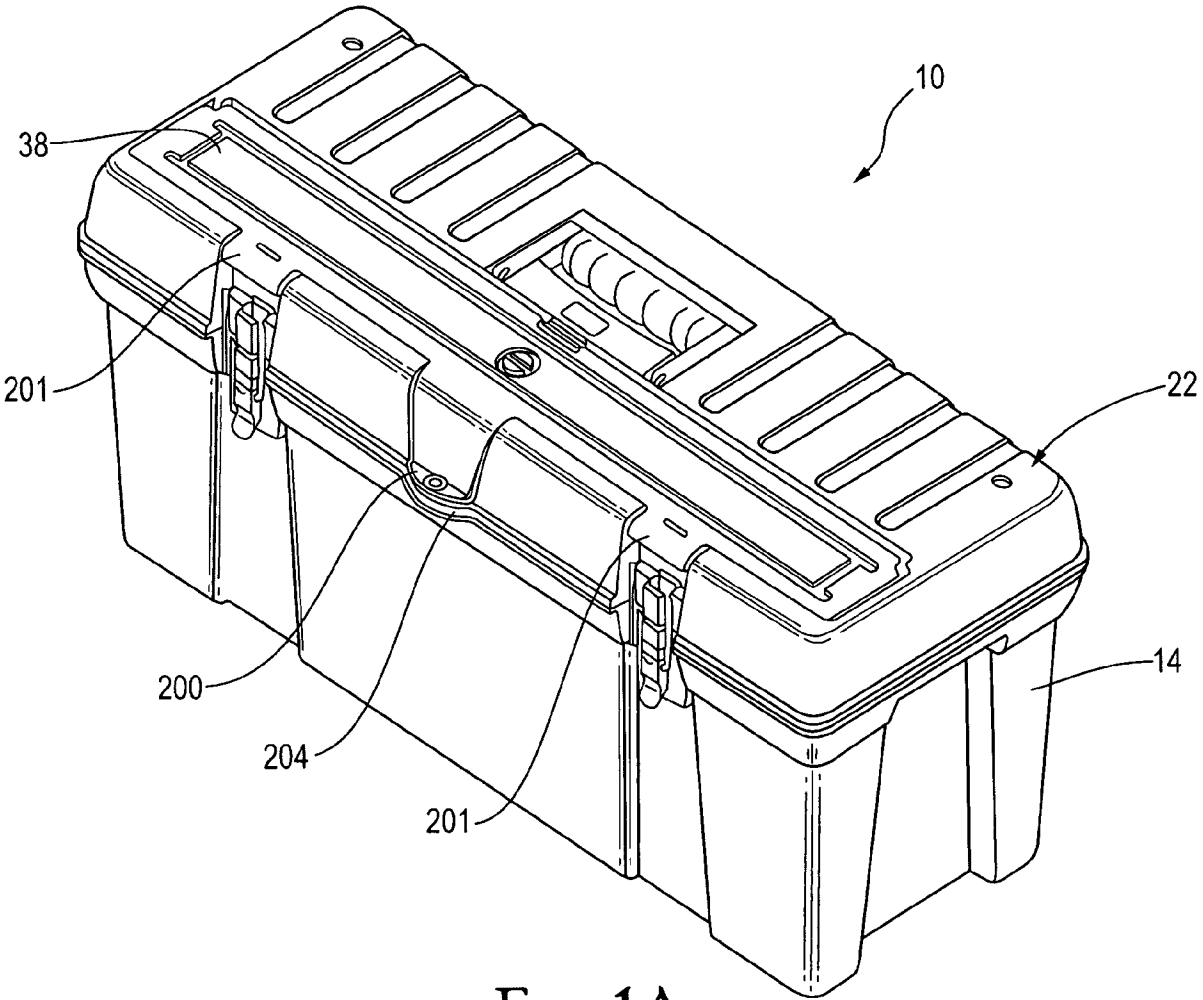
FIG. 1A is a perspective view of an embodiment of a tool container of the invention.

The second cover portion 38 includes an extended portion 200 that, when the second cover portion 38 is in the closed position, extends along the front side of the cover portion to a tab 204 formed at the upper peripheral surface 136 of the case 14, positioned intermediately of wall 124. This tab 204 has a hole 208 formed therethrough that is adapted to align with a hole 212 in the extended portion 200 of the second cover portion 38. A user may use these holes 208, 212 to lock the storage compartment using a combination lock or a key operated lock. When locked, the cover portion 22 is also locked. Alternatively, the tab 204 may be formed on the cover portion (see FIG. 1A) so that only the second cover portion 38 locks (not shown) when utilized. In such a case, the locking mechanisms 181 preferably include a ring portion configured to accommodate a combination or key lock. A tab may also be formed on both the cover portion 22 and the case 14, as shown in FIG. 1. The second cover portion may also include protruding portions 201 for a user to engage to lift second cover portion 38. These protruding portions 201 are curved downward so that the top of the cover portion 22 maintains a generally flat surface when the second cover portion 38 is in the closed position.

The present invention is not intended to be limited to the storage of a level, and the level is not required to be a part of the present invention.

Thus, while the invention has been described with reference to the certain illustrated embodiments, the words which have been used herein are words of description, rather than words or limitation. Changes may be made, within the purview of the appended claims, without departing from the scope and spirit of the invention in its aspects. Although the invention has been described herein with reference to particular structures, acts, and materials, the invention is not to be limited to the particulars disclosed, but rather extends to all equivalent structures, acts, and materials, such as are within the scope of the appended claims.

What is claimed is:

1. A tool container comprising:

a case portion defining a storage space, a one-piece cover portion being movably attached to said case portion and being pivotally moveable between a closed position in which said cover portion covers an upwardly facing opening of said storage space and an open position in which access to said storage space through said upwardly facing opening is permitted, said cover portion being securable in said closed position;

said one-piece cover portion having an elongated level storage space integrally formed in one piece therewith for storing a level therein, and a secondary cover portion pivotably mounted to said cover portion for movement between a closed position wherein said secondary cover portion covers the elongated level storage space to retain the level therein and an open position wherein access to the level stored in said elongated storage space is permitted; and a handle connected to said cover portion to facilitate transport of the tool container, wherein said secondary cover portion further comprises level mounting structure constructed and arranged to allow the level to be removably mounted to the secondary cover portion when the secondary cover portion is in its open position so that movement of the secondary cover portion into its closed position carries the level into the level storage space and movement of the secondary cover portion from its closed position into its open position moves the level out of the level storage space to facilitate worker access to the level.

2. A tool container according to claim 1, wherein the secondary cover portion includes a partially enclosed space constructed and arranged so that the level is removably mounted to the secondary cover portion by placing the level in the partially enclosed space.

3. A tool container according to claim 1, wherein the level is removably mounted to the secondary cover portion by being removably attached thereto.

4. A tool container according to claim 3, wherein the secondary cover portion includes one or more locking structures movable between locking and releasing positions, each locking structure including a locking surface that releasably engages a respective surface on the level when the locking structures are in their locking positions to removably attach to level to the secondary cover portion.

5. A tool container according to claim 4, wherein each locking structure is a resilient structure biased into its locking position.

6. A tool container according to claim 5, wherein each locking structure is integrally formed with the secondary cover portion.

7. A tool container according to claim 6, wherein the secondary cover portion and the integral locking structures are constructed of a molded plastic material.

8. A tool container according to claim 1, wherein the secondary cover portion is constructed and arranged such that when the secondary cover portion is in its closed position and the level is contained within the level storage space, the secondary cover portion is interengaged with the level such that the weight of the level tends to hold the secondary cover portion in its closed position.

9. A tool container according to claim 1, wherein said elongated level storage space is defined by a front wall, a back wall, two side walls, and a bottom wall, the secondary cover portion being pivotably mounted to at least one of the front wall, back wall, and two side walls.

10. A combination tool container and level comprising:

a case portion defining a storage space, a one-piece cover portion being movably attached to said case portion and being pivotally moveable between a closed position in which said cover portion covers an upwardly facing opening of the storage space and an open position in which access to the storage space through said upwardly facing opening is permitted, said cover portion being securable in said closed position;

said one-piece cover portion having an elongated level storage space integrally formed in one piece therewith;

a level disposed in the elongated level storage space in said cover portion, and a secondary cover portion pivotably mounted to said cover portion for movement between a closed position wherein said secondary cover portion covers the elongated level storage space to retain the level therein and an open position wherein access to the level stored in said elongated storage space is permitted; and a handle connected to said cover portion to facilitate transport of the tool container.

11. A combination tool container and level according to claim 10, said secondary cover portion further comprising level mourning structure constructed and arranged to allow the level to be removably mounted to the secondary cover portion when the secondary cover portion is in its open position so that movement of the secondary cover portion into its closed position carries the level into the level storage space and movement of the secondary cover portion from its closed position into its open position moves the level out of the level storage space to facilitate worker access to the level.

12. A combination tool container and level according to claim 11, wherein the secondary cover portion includes a partially enclosed space constructed and arranged so that the level is removably mounted to the secondary cover portion by placing the level in the partially enclosed space.

13. A combination tool container and level according to claim 11, wherein the level is removably mounted to the secondary cover portion by being removably attached thereto.

14. A combination tool container and level according to claim 13, wherein the secondary cover portion includes one or more locking structures movable between locking and releasing positions, each locking structure including a locking surface that releasably engages a respective surface on the level when the locking structures are in their locking positions to removably attach to level to the secondary cover portion.

15. A combination tool container and level according to claim 14, wherein each locking structure is a resilient structure biased into its locking position.

16. A combination tool container and level according to claim 15, wherein each locking structure is integrally formed with the secondary cover portion.

17. A combination tool container and level according to claim 16, wherein the secondary cover portion and the integral locking structures are constructed of a molded plastic material.

18. A combination tool container and level according to claim 10, wherein the secondary cover portion is constructed and arranged such that when the secondary cover portion is in its closed position and the level is contained within the level storage space, the secondary cover portion is interengaged with the level such that the weight of the level tends to hold the secondary cover portion in its closed position.

19. A combination tool container and level according to claim 10, wherein said elongated level storage space is defined by a from wall, a back wall, two side walls, and a bottom wall, the secondary cover portion being pivotably mounted to at least one of the front wall, back wall, and two side walls.

* * * * *